United States Patent [19]

Yoshizawa et al.

[11] 4,291,437

[45] Sep. 29, 1981

[54] COMBING ROLLER UTILIZED FOR AN OPEN-END SPINNING MACHINE

[75] Inventors: Toshio Yoshizawa, Chiryu; Yoshiaki Yoshida, Oobu; Katsuaki Sugiura, Okazaki, all of Japan

[73] Assignee: Kabushiki Kaisha Toyoda Jidoshokki Seisakusho, Aichi, Japan

[21] Appl. No.: 107,073

[22] Filed: Dec. 26, 1979

[30] Foreign Application Priority Data

Dec. 26, 1978 [JP] Japan ..... 53-179652

[51] Int. Cl.[3] ..... D01G 15/14; D01G 15/84

[52] U.S. Cl. ..... 19/112; 19/97; 29/121.4; 57/58.93

[58] Field of Search ..... 19/97, 112; 57/58.93, 57/58.95; 29/121.4

[56] References Cited

U.S. PATENT DOCUMENTS

| | | | |
|---|---|---|---|
| 3,968,542 | 7/1976 | Hollingsworth | 19/97 |
| 4,044,427 | 8/1977 | Ankrom et al. | 19/97 |
| 4,208,767 | 6/1980 | Schmolke | 19/97 |

*Primary Examiner*—Louis Rimrodt

*Attorney, Agent, or Firm*—Burgess, Ryan and Wayne

[57] ABSTRACT

In an improved combing roller provided with a metallic wire mounted on a body thereof comprising a main cylindrical body and a pair of flanges coaxially formed at both ends of the main cylindrical body, a base portion of the metallic wire rigidly pressed into a right hand or a left hand helical groove formed in the main body and the working direction of the metallic wire coincide with the rotational direction of the combing roller, if one of flanges on a side of the combing roller corresponding to the direction of progress of an imaginary right hand screw imaginarily engaged with the above-mentioned right hand helical groove or an imaginary left hand screw imaginarily engaged with the above-mentioned left hand helical groove when the imaginary screws are turned in the direction corresponding to the rotational direction of the combing roller, is defined as a first flange, while the other flange is defined as a second flange, the axial size of the free cylindrical space formed at the side of the first flange is smaller than the axial size of the free cylindrical space formed at the side of the second flange.

3 Claims, 7 Drawing Figures

COMBING ROLLER UTILIZED FOR AN OPEN-END SPINNING MACHINE

SUMMARY OF THE INVENTION

The present invention relates to a combing roller utilized for an open-end spinning machine and, more particularly, relates to an improved combing roller wherein the roller is provided with a metallic wire mounted on the peripheral surface thereof without a free space where fibers can not receive effective combing action.

BACKGROUND OF THE INVENTION

In a known embodiment of the open-end spinning machine, a bundle of fibers supplied from an upstream supplying mechanism is opened by means of a combing roller, so as to separate the bundle into individual fibers, and the separated fibers are carried into a twisting mechanism so as to form a twisted yarn. In such an open-end machine, a combing roller provided with a metallic wire helically secured on the peripheral surface of the main body of the combing roller is utilized.

It is well known that the above mentioned metallic wire is provided with a cross-section comprising a laterally expanded base portion and a teeth portion projected upward from the base portion. When the metallic wire is mounted on the peripheral surface of the main body of the combing roller, the base portion of the metallic wire is pressed into a helical groove formed on the peripheral portion of the main body of the combing roller by means of a press roller, so that the metallic wire can be rigidly mounted on the main body of the combing roller. To attain an effective action of the combing roller, the helical groove is formed on the peripheral portion of the main body with a pertinent pitch along the axial direction of the combing roller. It is well known that the main body is coaxially provided with a flange at each end thereof. Therefore, in such a combing roller, cylindrical spaces are formed on the peripheral portion of the main body between the two flanges and the corresponding spiral portions of the metallic wire, which are the starting and terminal portions of the metallic wire. The axial size of those cylindrical spaces has been allowed to be almost the same as the above-mentioned pitch of the helical groove, that is the axial pitch of the metallic wire. It is the understanding of the inventors of the present invention that the reasons for the above-mentioned axial size are as follows. First since the mounting of the metallic wire on the main body of the combing roller is carried out by pressing the shoulder of the base portion of the metallic wire into the helical groove of the main body by means of a pressing disc having a certain thickness, it is necessary to have a space for carrying out the pressing operation when the pressing operation is carried out on the portions of the wire closest to the above-mentioned flanges, and; second, it is not recognized that the cylindrical spaces at the two end portions of the main body of the combing roller give rise to a serious problem.

According to the technical principle of the open-end spinning method, it is essential to feed well separated individual fibers into a yarn forming mechanism, such as a spinning rotor, and the function of the combing roller is to do this. Therefore, generally speaking, the body of the combing roller and the metallic wire are made with precision, and the mounting of the metallic wire on the main body of the combing roller is carried out with precision, so as to ensure the function of the combing roller. However, it is the experience of the inventors of the present invention that, even if the combing roller is made with precision as mentioned above, it is quite difficult to eliminate possible creation of neps in the twisted yarn, and it is their understanding that one reason for the creation of such neps is due to the defective functioning of the conventional combing roller which results from the above mentioned cylindrical spaces.

Therefore, the principal object of the present invention is to provide an improved combing roller which does not give rise to the above mentioned defective function of the conventional combing roller.

To attain the purpose of the present invention, an analysis of the action of the conventional combing roller was carefully carried out, and it was found that the above-mentioned cylindrical spaces formed at both of the axial end portions of the main body of the combing roller are free from the combing action even though a part of a supplied bundle of individual fibers is introduced therein. Consequently, it is possible for blocks of entangled fibers to be fed into the yarn forming mechanism, such as the spinning rotor. The above-mentioned cylindrical spaces are hereinafter referred to as free spaces.

Based on the above-mentioned result, the inventors of the present invention have devised the following described combing roller to attain the purpose of the present invention. That is, in the combing roller, if the rotation of the combing roller is counter-clockwise and a right hand helical groove for receiving the base portion of the metallic wire is formed on the cylindrical surface of the main body with the working surface of each tooth of the metallic wire facing the rotational direction of the combing roller, the base portion of the metallic wire is rigidly inserted into the above-mentioned helical groove in such a condition that the shoulder side of the metallic wire faces the direction of progress of an imaginary right hand screw when the right hand screw is turned in the clockwise direction when in imaginary engagement with the right hand helical groove; while if the combing roller is turned in the counter-clockwise direction and the metallic wire is rigidly mounted into a left hand helical groove with the working surface of each tooth of the metallic wire facing the rotational direction of the combing roller, the base portion of the metallic wire is rigidly inserted into the above-mentioned helical groove in such a condition that the shoulder side of the metallic wire faces the direction of progress of an imaginary left hand screw turned in the clockwise direction when in imaginary engagement with the left hand helical groove. It is preferable to reduce the axial size of the free space between the flange on the end corresponding to the direction of progress of the above-mentioned imaginary screws when the screws are turned in the counter-clockwise direction when in imaginary engagement with the respective said helical grooves of the combing roller and the end of the metallic wire to as small as possible. Such free space is hereinafter referred to as a first free space, and the other free space formed at a position between the other flange and the other end of the metallic wire is hereinafter referred to a second free space.

DETAILED EXPLANATION OF THE PRESENT INVENTION

Figure 1:
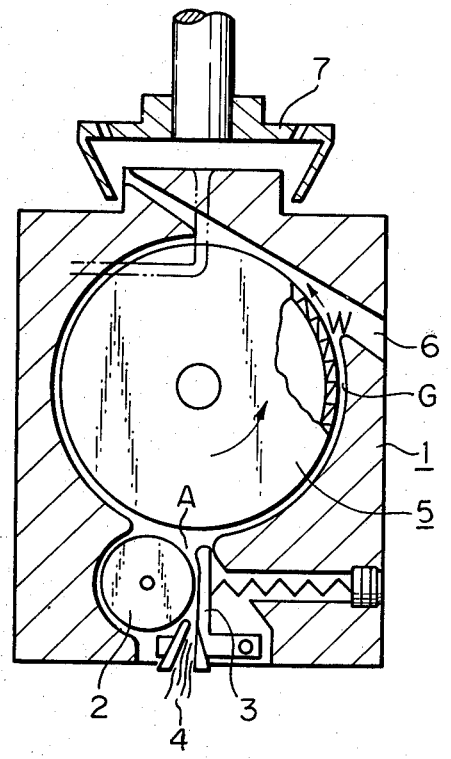
Fig. 1 PRIOR ART
FIG. 1 is a schematic side view, partly in section, of the known open-end spinning unit.

Before explaining the preferred embodiments of the present invention, for the sake of a clearer understanding the present invention, the structure of the conventional combing roller and the defect thereof will first be explained in detail, with reference to the attached drawings of FIGS. 1, 2, 3, 4 and 5. It is possible to manufacture the following four types of combing rollers.

(1) In the case of mounting a metallic wire 8 on a main body 5*a* provided with a right hand helical groove 9 in such condition that the working surface of each tooth faces toward the counter-clockwise rotational direction of the combing roller 5:

(a) the shoulder side of the metallic wire 8 faces the direction of progress of a right hand screw in the helical groove 9 in an imaginary screw engagement when the right hand screw is turned to the counter clockwise direction;

(b) the shoulder side of the metallic wire 8 faces the direction opposite to the direction of progress of the right hand screw mentioned in 1(*a*), above.

(2) In the case of mounting a metallic wire 8 on the main body 5*a* provided with a left hand helical groove 9 in such condition that the working surface of each tooth faces toward the counter-clockwise rotational direction of the combing roller 5:

(a) the shoulder side of the metallic wire 8 faces the direction of progress of a left hand screw in the helical groove 9 in an imaginary screw engagement when the left hand screw is turned to the clockwise direction;

(b) the shoulder side of the metallic wire 8 faces the direction opposite to the direction of progress of the left hand screw mentioned in 2(*a*), above.

It is well known that when the metallic wire 8 is pressed into the helical groove 9, the base portion 8*a* of the metallic wire 8 is continuously pressed into the helical groove 9 toward the working direction W (in FIG. 1) of the metallic wire 8. However, to prevent any possible damage to the working face and point of each tooth of the metallic wire 8, and also, to prevent any possible damage to the helical groove 9, in the mounting operation of the metallic wire on the main body 5*a* of the combing roller, only the two conditions (1)-(a) and (2)-(b) mentioned above can be practically applied. That is, the combing rollers 5 having the construction illustrated in FIGS. 2 and 4, and FIGS. 3 and 5 are utilized at present.

Figure 2:
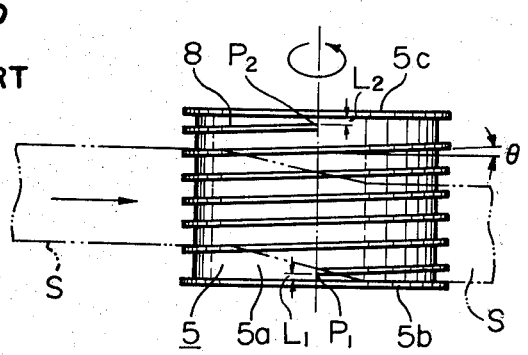
Fig. 2 PRIOR ART
FIG. 2 is a schematic front view of a combing roller utilized for the open-end spinning unit illustrated in FIG. 1, wherein the combing roller is provided with a metallic wire rigidly inserted into a right hand helical groove of formed on the main body thereof.
Figure 4:
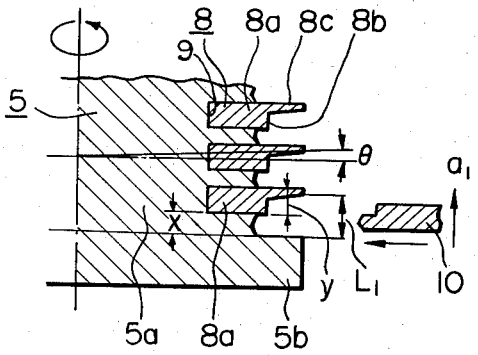
Fig. 4 PRIOR ART
FIG. 4 is a schematic sectional view of an end portion of the combing roller illustrated in FIG. 2, wherein a metallic wire is mounted in the known condition.

In the case of utilizing the combing roller 5 illustrated in FIGS. 2 and 4, when a silver S is fed to the combing roller 5, since the combing roller 5, provided with a metallic wire 8 mounted thereon in a right hand helical groove, is rotated counter-clockwise, there is a tendency of displacing the fibers toward the direction of progress of an imaginary right hand screw turned counter-clockwise when in imaginary screw engagement with the helical groove 9. Such displacement tendency of the bundle of fibers S is represented by a two dot broken line in FIG. 2. It is understood that, according to the above-mentioned displacement, a plurality of fibers are introduced into the free space, that is the first free space, between a flange 5*b* located on the end of the roller corresponding to the above-mentioned direction of progress of the imaginary right hand screw turned counter-clockwise in imaginary engagement with the helical groove 9 and the adjacent terminal of the metallic wire 8. On the other hand, there is a tendency not to supply fibers into the second free space between the other flange and the end of the metallic wire 8 adjacent thereto. It must be recognized that the fibers introduced into the working zone of the combing roller 5 receive desirable opening action by imparting the combing action of the teeth of the metallic wiere 8. However, in the above-mentioned first free space, since there are no teeth of the metallic wire on the peripheral surface of the main body 5, it is impossible to apply any combing action of the teeth of the metallic wire 8 to the fibers introduced therein and, consequently, such non-opened fibers are introduced into the yarn forming mechanism so that neps are created. Accordingly, it is the concept of the present inventors that, if the above-mentioned first free space is restricted so that it is as small as possible, the problem due to the possible creation of neps can be eliminated. On the other hand, the axial size of the above-mentioned second free space is not serious, because of the tendency of fibers not to be introduced into this second free space and, therefore, the second free space can be lager than the first free space.

In FIG. 4, indicating the conventional combing roller 5, the helical angle of the right hand groove is represented by $\theta$. The conventional process of mounting the metallic wire 8 on the main body 5*a* of the combing roller 5 by utilizing a pressing disc 10 is hereinafter explained, with reference to FIGS. 2 and 4. That is, a starting end of the metallic wire 8 having a cross section as shown in FIG. 4 is firstly pressed into a starting point $P_1$. The base portion 8*a* of the metallic wire 8 is continuously pressed into the helical groove 9 by pressing the shoulder 8*b* of the metallic wire 8, by means of a pressing disc 10 which is in rotatable contact with the shoulder 8*b*, toward the working direction W (FIG. 1) of the metallic wire and into the helical groove 9. In the above-mentioned operation, the pressing roller 10 is displaced toward a direction $a_1$, which is parallel to the axial direction of the body of the combing roller 5, since the pressing roller 10 is displaceably mounted on a shaft (not shown) which is parallel to the axial direction of the body of the combing roller 4. As is well known, the metallic wire 8 is continuously supplied from a supply roll of the metallic wire (not shown). In such a mounting operation, since the pressing disc 10 is always located at a position separated from any portion of the helical groove 9 into which the metallic wire 8 has not been pressed, there is no possibility of damaging the helical groove 9 before the base portion 8*b* of the metallic wire is pressed into the groove 9. It must be further recognized that since the helical groove 9 is formed in the condition of a right hand thread, when the base portion 8*b* of the metallic wire 8 is pressed into the helical groove 9, the teeth portion 8*c* of the metallic wire 8 has a tendency to slightly incline toward the axial direction opposite to the flange 5*b*, and there is no possibility of damaging the teeth portion 8*c* of the metallic wire 8 by its coming into contact with the pressing disc 10. It should be noted that it is possible to carry out the above mentioned mounting operation without damaging the groove 9 or teeth portion 8*c* because a wire 8 having the cross section illustrated in FIG. 4 is utilized in the conventional combing roller 5 illustrated in FIGS. 2 and 4.

Referring to FIGS. 2 and 4, the distance from the starting end of the helical groove 9, containing the metallic wire 8, to the flange 5*b* is represented by x, while the width of the shoulder 8*b*, which is almost equal to the distance from the tip of the teeth 8*c* to the shoulder side of the metallic wire 8, is represented by y. In the conventional combing roller, in order to accomodate the pressing disk 10, the axial size $L_1$ of the first free space is a sum of x and y. However, if a metallic wire 8 having such a cross-section that the shoulder portion of the metallic wire were formed at the opposite side of the teeth portion 8*c* to that illustrated in FIG. 4 could be utilized, and any possible damage to the teeth portion 8*c* by the pressing disc 10 could be effectively prevented, the size $L_1$ of the first free space could be remarkably reduced because the size $L_1$ would then be equal to x. Obviously the second free space under such a construction would have to be larger than the first free space due to the requirement for accomodating the shoulder 8*b*. However, since, as mentioned previously, it is the first free space which creates the problem of neps in the embodiment illustrated in FIGS. 2 and 4, the size of the second free space would not be a problem. It is the concept which formed the logical basis for the present invention.

Figure 3:
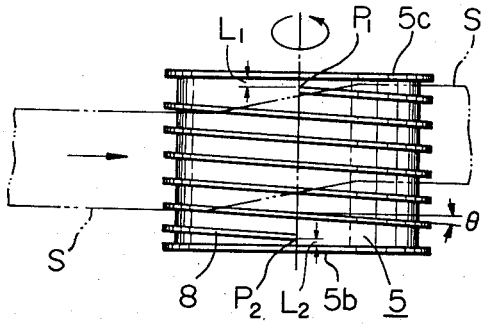
Fig. 3 PRIOR ART
FIG. 3 is a schematic front view of a combing roller utilized for the open-end spinning unit illustrated in FIG. 1, wherein the combing roller is provided with a metallic wire rigidly inserted into a left hand helical groove formed on the main body thereof.
Figure 5:
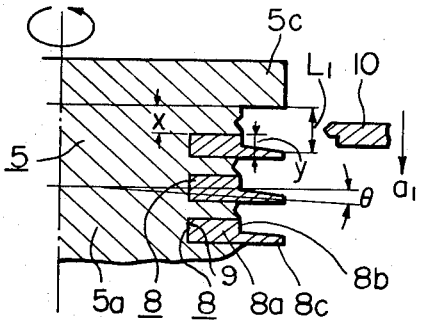
Fig. 5 PRIOR ART
FIG. 5 is a schematic sectional view of an end portion of the combing roller illustrated in FIG. 3, wherein a metallic wire is mounted in the known condition.

In the case of the conventional combing roller 5 illustrated in FIGS. 3 and 5, a similar condition to the above-described combing roller 5 illustrated in FIGS. 2 and 4 can be observed, except that in the case of FIGS. 3 and 5 the base portion 8*a* of the metallic wire 8 is pressed into the left hand helical groove 9 formed in the main body 5*a* of the combing roller 5. Therefore, elements having the same functions as those of the combing roller 5 illustrated in FIGS. 2 and 4 are represented by identical reference numerals, and the explanation thereof is omitted here.

The construction and function of the improved combing roller according to the present invention will now be explained in detail.

Figure 6:
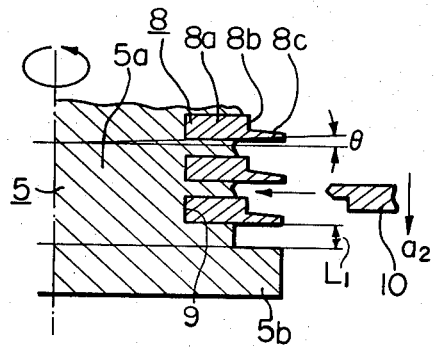
FIG. 6 is a schematic sectional view of an end portion of the combing roller illustrated in FIG. 2, wherein a metallic wire is mounted in the particular condition according to the present invention.

Referring to FIGS. 2 and 6, wherein one of the embodiments of the improved combing roller according to the present invention is illustrated, the combing roller 5 is provided with a metallic wire 8 mounted on the main body 5*a* in such a condition that the base portion 8*a* of the metallic wire 5 is pressed into the right hand helical groove 9 by pressing the shoulder portion 8*b* by means of the pressing disc 10. It must be noted that the cross section of the metallic wire 8 is different from that of the conventional combing roller 5 illustrated in FIGS. 2 and 4. That is, in this embodiment, the shoulder portion 8*b* of the metallic wire 8 is projected toward the side opposite to that of the metallic wire 8 illustrated in FIG. 4. In other words, the metallic wire 8 has a laterally expanded base portion 8*a* which is projected toward the direction of progress of an imaginary right hand screw turned in the clockwise direction when in imaginary engagement with the right hand helical groove 9. If such a construction is applied to the combing roller 5, the size $L_1$ of the first free space can be reduced to x, and the influence of the width y of the shoulder portion 8*b* of the metallic wire 5 can be completely eliminated. On the other hand the axial size $L_2$ of the second free space is x+y. However, as discussed in previous paragraphs, even if the size $L_1$ of the first free space can be remarkably reduced, the basic requirements of preventing any possible damage to the teeth portion 8*c* of the metallic wire and the helical groove 9 during the mounting operation must be met.

To find a solution to the question of how to meet the above-mentioned requirements, repeated experiments were conducted. It was finally concluded that, if the pressing of the metallic wire 8 into the helical groove 9 is started at the terminal end $P_2$ in the mounting operation of the metallic wire 8 to produce the conventional combing roller 5 illustrated in FIGS. 2 and 4, and completed at the starting point $P_1$ of the above-mentioned mounting operation of the metallic wire 8 to produce the combing roller 5 illustrated in FIGS. 2 and 4, the second requirement of preventing any possible damage to helical groove 9 can be satisfied. The reason for this is the same as that mentioned in the case of the mounting operation for the conventional combing roller 5 illustrated in FIGS. 2 and 4.

A more delicate problem to solve was the first requirement of preventing damage to the teeth portion 8*c*. It will be remembered that in the mounting operation of the metallic wire 8 on the main body 5*a* of the conventional combing roller 5, the pressing disc 10 continuously presses on the shoulder portion 8*b* of the metallic wire 8 in the same direction as the working direction of the metallic wire so as to prevent any possible damage to or deformation of the teeth portion 8*c* of the metallic wire 8 during the operation. However, in the mounting operation of the metallic wire 8 to produce the combing roller 5 illustrated in FIGS. 2 and 6, since the operation is carried out in the reverse direction to the operation for producing the conventional combing roller 5 illustrated in FIGS. 2 and 4, the pressing disc 10 must be continuously moved in the reverse direction to the working direction W (FIG. 1) of the metallic wire 8. However, after repeated experiments, it was concluded that such a mounting operation does not actually create the possibility of damaging the teeth portion 8*c* of the metallic wire 8. The main reason for this was found to be that, when the mounting operation is carried out, the teeth portion 8*c* of the metallic wire 8 has a tendency to incline slightly in the axial direction toward the flange 5*b*, so that possible contact of the pressing disc 10 with the teeth portion 8*c* of the metallic wire 8 can be sufficiently prevented.

As mentioned above, the metallic wire 8 illustrated in FIGS. 2 and 6 has a unique construction and the mounting thereof is also unique. Because of these two factors, since the axial size $L_1$ of the first free space is remarkably reduced, the problem due to insufficient opening action of the conventional combing roller 5 can be effectively eliminated.

Figure 7:
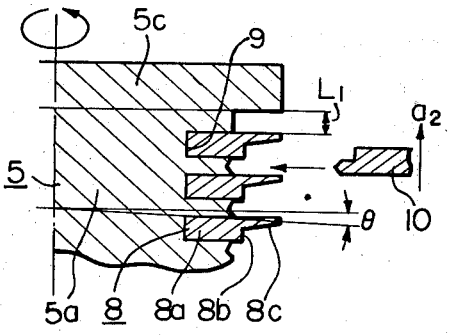
FIG. 7 is a schematic sectional view of an end portion of the combing roller illustrated in FIG. 3, wherein a metallic wire is mounted in the particular condition according to the present invention.

The other embodiment of the improved combing roller 5 according to the present invention is illustrated in FIGS. 3 and 7. In this embodiment, the metallic wire 8 having the cross section illustrated in FIG. 7 is mounted on the left hand helical groove 9 in such condition that the mounting operation is started at the terminal position $P_2$ of the wire 8 of the conventional combing roller of FIGS. 3 and 5, and is completed at the starting position $P_1$ of the wire 8 of the conventional combing roller 5 illustrated in FIGS. 3 and 5. During the mounting operation of the metallic wire 8 of the present invention, the pressing disc 10 presser on the shoulder portion 8*b* of the metallic wire 8 in the direction reverse to the working direction of the metallic wire 8. However, for the same reason as in the case of the combing roller 5 illustrated in FIGS. 2 and 6, no serious problems are created during the mounting operation of the metallic wire 8 on the main body 5*a* of the combing roller 5. In the second embodiment of the combing roller 5 illustrated in FIGS. 3 and 7, since the axial size of the first free space $L_2$ is remarkably restricted, the same as the first free space $L_1$ of the first embodiment of the present invention, a similar result to that of the first embodiment can be created.

What is claimed is:

1. An improvement of a combing roller utilized for an open-end spinning machine, wherein a metallic wire is mounted on a body of said combing roller, said body comprises a main cylindrical body and a pair of flanges coaxially formed at both ends of said main body, a base portion of said metallic wire is pressed into a right hand or left hand helical groove, and the working direction of said metallic wire coincides with the rotational direction of said combing roller, said improvement comprising a first free cylindrical space formed on said main body at a first position between one of said flanges located at a side corresponding to the direction of progress of either an imaginary right hand screw imaginarily engaged with said right hand helical groove or an imaginary left hand screw imaginarily engaged with said left hand groove when said imaginary screw is turned in the counter-clockwise direction and a tooth point of the end portion of said metallic wire, a second free cylindrical space formed on said main body at a second position between the other flange and a tooth point of the other end portion of said metallic wire, the axial size of said first cylindrical space being smaller than that of said second cylindrical space.

2. An improvement of a combing roller according to claim 1, wherein said metallic wire is provided with a laterally expanded base portion projected toward a direction opposite to said direction of progress of either said imaginary left hand screw in said imaginary engagement or said imaginary right hand screw in said imaginary engagement when said imaginary screw is turned in the counter-clockwise direction and a teeth portion projected upward from said base portion.

3. An improvement of a combing roller according to claim 2, wherein said metallic wire is provided with a substantially flat side surface at the side opposite to said laterally expanded base portion.

* * * * *

UNITED STATES PATENT AND TRADEMARK OFFICE

CERTIFICATE OF CORRECTION

PATENT NO. : 4,291,437

DATED : September 29, 1981

INVENTOR(S) : Toshio Yoshizawa, et al

It is certified that error appears in the above—identified patent and that said Letters Patent is hereby corrected as shown below:

Column 3, line 5 : cancel "of"

Column 4, line 31: "wiere" should be --wire-- line 46: "lager" should be --larger--

Signed and Sealed this

*Third* Day of *August 1982*

[SEAL]

*Attest:*

GERALD J. MOSSINGHOFF

*Attesting Officer*

*Commissioner of Patents and Trademarks*